US007934783B2

(12) United States Patent
Van Vooren et al.

(10) Patent No.: US 7,934,783 B2
(45) Date of Patent: May 3, 2011

(54) COUNTERBALANCE ASSEMBLY FOR A DISHWASHER DOOR AND ASSOCIATED METHOD

(75) Inventors: Gregory Van Vooren, Greenville, NC (US); Jerry Olesen, Kinston, NC (US); Jason Duckworth, Kinston, NC (US); Ronald G. Tynes, Hendersonville, TN (US); Daniel M. Stewart, Kinston, NC (US); John Helgesen, Rock Hill, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 530 days.

(21) Appl. No.: 12/174,410

(22) Filed: Jul. 16, 2008

(65) Prior Publication Data

US 2009/0072686 A1 Mar. 19, 2009

Related U.S. Application Data

(63) Continuation-in-part of application No. 11/869,911, filed on Oct. 10, 2007, now Pat. No. 7,862,132.

(60) Provisional application No. 60/916,013, filed on May 4, 2007.

(51) Int. Cl.
*A47B 88/00* (2006.01)

(52) U.S. Cl. ..... 312/328; 312/319.2; 312/228

(58) Field of Classification Search .... 312/319.2–319.4, 312/327, 328, 311, 228; 68/3 R, 196; 16/78, 16/81, 72, 286; 49/389, 387; 474/1, 58, 474/62

See application file for complete search history.

(56) References Cited

U.S. PATENT DOCUMENTS

| | | | | |
|---|---|---|---|---|
| 1,963,388 | A | 6/1934 | Smith | |
| 2,237,795 | A | 4/1941 | Shroyer | |
| 2,553,439 | A * | 5/1951 | Carmichael | 474/62 |
| 2,833,270 | A | 5/1958 | Brown et al. | |
| 3,049,114 | A * | 8/1962 | Carnahan et al. | 126/191 |
| 3,288,154 | A | 11/1966 | Jacobs | |
| 3,450,125 | A | 6/1969 | Hopkins | |
| 3,466,105 | A | 9/1969 | Guth | |
| 3,820,866 | A * | 6/1974 | Kaldenberg | 312/276 |
| 3,837,119 | A | 9/1974 | Conneally et al. | |
| 3,921,252 | A | 11/1975 | Guth | |
| 3,955,865 | A * | 5/1976 | Wilson | 126/191 |

(Continued)

FOREIGN PATENT DOCUMENTS

| | | |
|---|---|---|
| CH | 683886 | 6/1994 |

(Continued)

*Primary Examiner* — Janet M Wilkens
*Assistant Examiner* — Dan Rohrhoff
(74) *Attorney, Agent, or Firm* — Alston & Bird LLP

(57) ABSTRACT

A dishwasher is provided, comprising a door pivotably engaged with a body and a counterbalance assembly coupled therebetween for facilitating pivoting of the door. The counterbalance assembly includes a first and second biasing member, each coupled to the body and serially engaged with a respective first and second flexible element coupled to the door. A guide member is secured to the body and includes a fixed arcuate member defining a first guide track, and a pulley rotatable about an axis and defining a second guide track. The first flexible element is at least partially wrapped about each of the fixed arcuate member and the pulley so as to serially engage the first and second guide tracks. The second flexible element is at least partially wrapped about a second side of the fixed arcuate member so as to engage the first guide track. An associated apparatus and method are also provided.

18 Claims, 14 Drawing Sheets

U.S. PATENT DOCUMENTS

| | | | | |
|---|---|---|---|---|
| 3,978,617 | A | 9/1976 | Eventoff | |
| 4,069,545 | A * | 1/1978 | Holet et al. | 16/49 |
| 4,887,393 | A * | 12/1989 | Cysewski | 49/385 |
| 4,898,493 | A | 2/1990 | Blankenburg | |
| 4,951,693 | A * | 8/1990 | Archambault | 134/57 DL |
| 5,226,706 | A | 7/1993 | Tuller | |
| 5,341,542 | A * | 8/1994 | Hannan et al. | 16/289 |
| 5,383,724 | A * | 1/1995 | Wrangberth et al. | 312/325 |
| 5,452,184 | A | 9/1995 | Scholder et al. | |
| 5,546,632 | A * | 8/1996 | Robinson et al. | 16/54 |
| 5,980,006 | A * | 11/1999 | Wilhelmstatter et al. | 312/319.1 |
| 5,988,933 | A * | 11/1999 | Wilhelmstatter et al. | 403/381 |
| 6,397,836 | B1 * | 6/2002 | Pelletier et al. | 126/194 |
| 6,467,128 | B1 | 10/2002 | Damani | |
| 6,505,381 | B1 | 1/2003 | Thomson et al. | |
| 6,557,958 | B1 | 5/2003 | Motta et al. | |
| 7,252,082 | B2 | 8/2007 | Bartmann et al. | |
| 7,472,457 | B2 | 1/2009 | Giovannetti | |
| 7,862,132 | B2 * | 1/2011 | Tynes et al. | 312/328 |
| 2004/0113531 | A1 * | 6/2004 | Raches | 312/319.2 |
| 2008/0122331 | A1 * | 5/2008 | Haeberle | 312/319.1 |

FOREIGN PATENT DOCUMENTS

| | | |
|---|---|---|
| DE | 4230410 | 3/1994 |
| GB | 2 054 733 A | 2/1981 |
| KR | 2001093962 | 4/2000 |

* cited by examiner

COUNTERBALANCE ASSEMBLY FOR A DISHWASHER DOOR AND ASSOCIATED METHOD

CROSS REFERENCE TO RELATED APPLICATIONS

This application is a continuation-in-part of U.S. patent application Ser. No. 11/869,911 filed Oct. 10, 2007 now U.S. Pat. No. 7,862,132, which claims priority from U.S. Provisional Application No. 60/916,013 entitled "Counterbalance Assembly for a Dishwasher Door and Associated Method" filed May 4, 2007, of which the contents of both are incorporated herein by reference.

BACKGROUND OF THE INVENTION

1. Field of the Invention

Embodiments of the present invention relate to dishwashers and, more particularly, to a counterbalance assembly for a dishwasher door, and an apparatus and method associated therewith.

2. Description of Related Art

A dishwasher typically includes a wash tub for containing the dishware to be washed, wherein the tub defines a front opening. The front opening is configured to be engaged by a door for closing/sealing the front opening. The door is typically hinged at the lower end thereof such that the upper end of the door can be pivoted downward so as to permit access to the interior of the tub.

The dishwasher may include a device for balancing or counterbalancing the weight of the door, when opening and closing the door. For example, U.S. Pat. No. 5,226,706 to Tuller discloses an adjustable door balancing mechanism that includes a counterbalance spring. The counterbalance spring extends between the door and an adjustable bracket mounted to the tub support. The tension in the counterbalance spring may be varied by changing the position of the adjustable bracket.

Despite these improvements in counterbalancing a dishwasher door, it would be advantageous for the door of the dishwasher to be balanced or counterbalanced so as to allow for smooth opening and closing of the door. That is, it may be advantageous to configure the door so as to prevent the door from inadvertently pivoting to the open or closed positions and/or to allow for the door to be maintained at various positions between the open and closed positions.

Therefore, it would be desirable to provide a counterbalance assembly that facilitates opening and closing of a dishwasher door. In addition, it may be desirable to provide a counterbalance assembly that may be easily integrated with a dishwasher, is cost efficient, and may be readily adjusted.

BRIEF SUMMARY OF THE INVENTION

The above and other needs may be met by embodiments of the present invention which, in one embodiment, provides an appliance, comprising an appliance body having a door pivotably engaged therewith. A counterbalance assembly is coupled to the appliance body for facilitating pivoting of the door about the engagement with the appliance body, wherein the counterbalance assembly comprises a first and a second biasing member each coupled to the appliance body. A guide member is coupled to the appliance body and includes a fixed arcuate member defining a first guide track, and a pulley element rotatable about an axis and defining a second guide track. The first guide track of the fixed arcuate member is parallel to and offset from the second guide track of the pulley element along the axis thereof. A first flexible element has a first end serially engaged with the first biasing member and extends therefrom to at least partially wrap about the pulley element and about a first side of the fixed arcuate member, so as to serially engage the first and second guide tracks, whereafter a second end of the first flexible member, opposed to the first end thereof, is coupled to the door. A second flexible element has a first end serially engaged with the second biasing member and extends therefrom to at least partially wrap about a second side of the fixed arcuate member so as to engage the first guide track, wherein the second side of the fixed arcuate member is substantially opposite the first side thereof, whereafter a second end of the second flexible member, opposed to the first end thereof, is coupled to the door.

Another aspect of the present invention comprises a method for facilitating pivoting of a door with respect to a body of an appliance, wherein the body includes a guide member secured thereto. The guide member includes a fixed arcuate member defining a first guide track and a pulley element rotatable about an axis and defining a second guide track, wherein the first guide track of the fixed arcuate member is parallel to and offset from the second guide track of the pulley element along the axis thereof. Such a method comprises coupling each of a first and a second biasing member to a body of an appliance, wherein the body has a door pivotably engaged therewith, and serially engaging a first end of each of a first and a second flexible element with the respective first and second biasing member. A second end of each of the first and second flexible elements is coupled to the door, wherein the second ends are opposed to the respective first ends of the first and second flexible elements. The first flexible element is wrapped at least partially about the pulley element and about a first side of the fixed arcuate member, such that the first flexible element serially engages the first and second guide tracks. The second flexible element is wrapped at least partially about a second side of the fixed arcuate member, such that the second flexible element engages the first guide track, wherein the second side of the fixed arcuate member is opposite the first side.

Yet another aspect provides a counterbalance assembly coupled between a door and a body of an appliance, for facilitating pivoting of the door with respect to the body. Such a counterbalance assembly comprises a first and a second biasing member, wherein each biasing member is adapted to be coupled to the body, and a guide member adapted to be coupled to the body, wherein the guide member includes a fixed arcuate member defining a first guide track, and a pulley element rotatable about an axis and defining a second guide track, with the first guide track of the fixed arcuate member being parallel to and offset from the second guide track of the pulley element along the axis thereof. A first flexible element has a first end serially engaged with the first biasing member and extends therefrom to at least partially wrap about the pulley element and about a first side of the fixed arcuate member, so as to serially engage the first and second guide tracks, whereafter a second end of the first flexible member, opposed to the first end thereof, is adapted to be coupled to the door. A second flexible element has a first end serially engaged with the second biasing member and extends therefrom to at least partially wrap about a second side of the fixed arcuate member so as to engage the first guide track, wherein the second side of the fixed arcuate member is substantially opposite the first side, whereafter a second end of the second flexible member, opposed to the first end thereof, is adapted to be coupled to the door.

Aspects of the present invention may thus provide significant advantages as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 13:
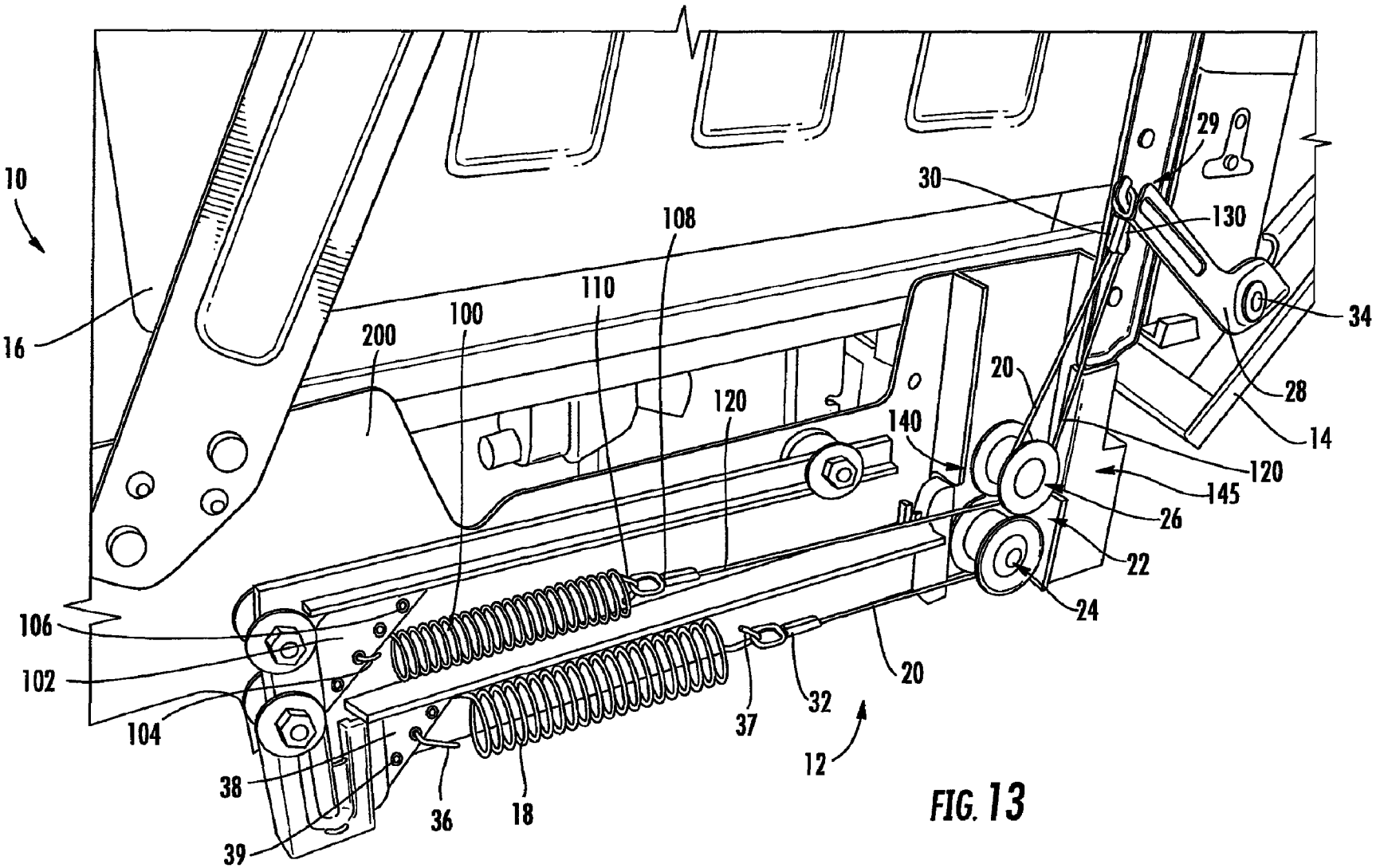
Figure 14:
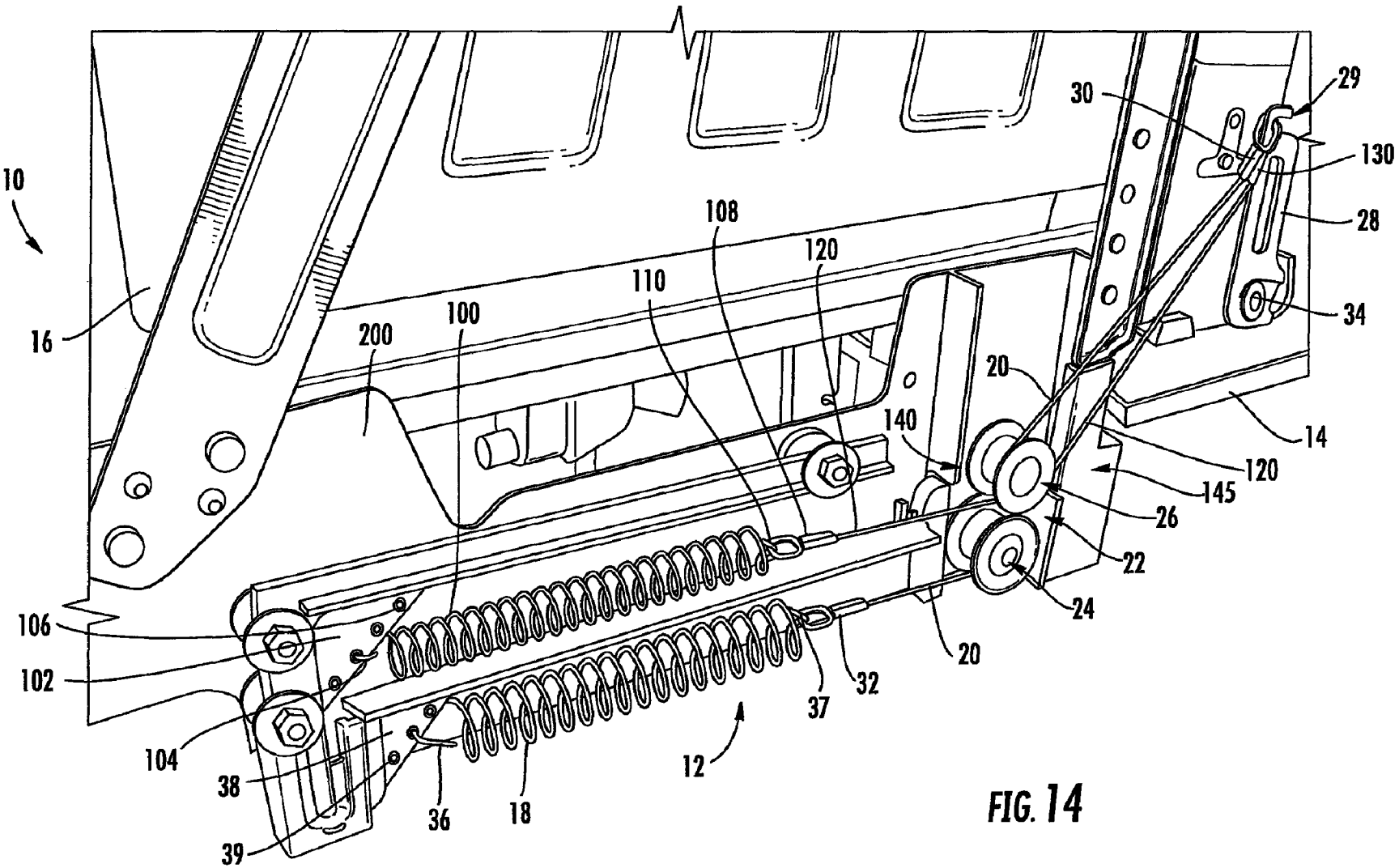

FIG. 13 illustrates a partial perspective view of a dishwasher including a door counterbalance assembly having a pair of biasing members, with a dishwasher door in a medial position between an open and closed position, according to one embodiment of the present invention; and FIG. 14 illustrates a partial perspective view of a dishwasher including a door counterbalance assembly having a pair of biasing members, with a dishwasher door in an open position, according to one embodiment of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
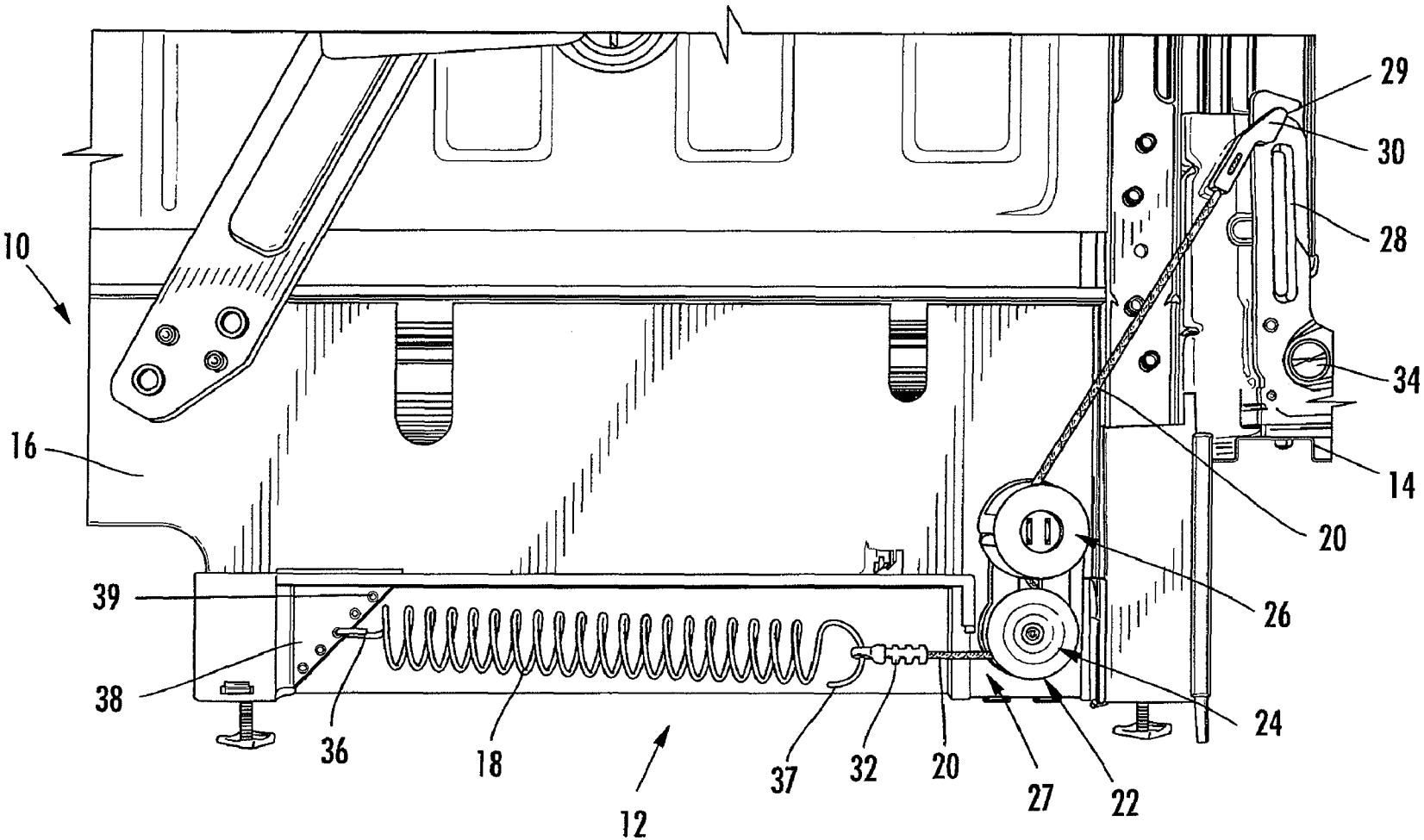
FIG. 1 illustrates a partial view of a dishwasher including a door counterbalance assembly, with a dishwasher door in an open position, according to one embodiment of the present invention.
Figure 2:
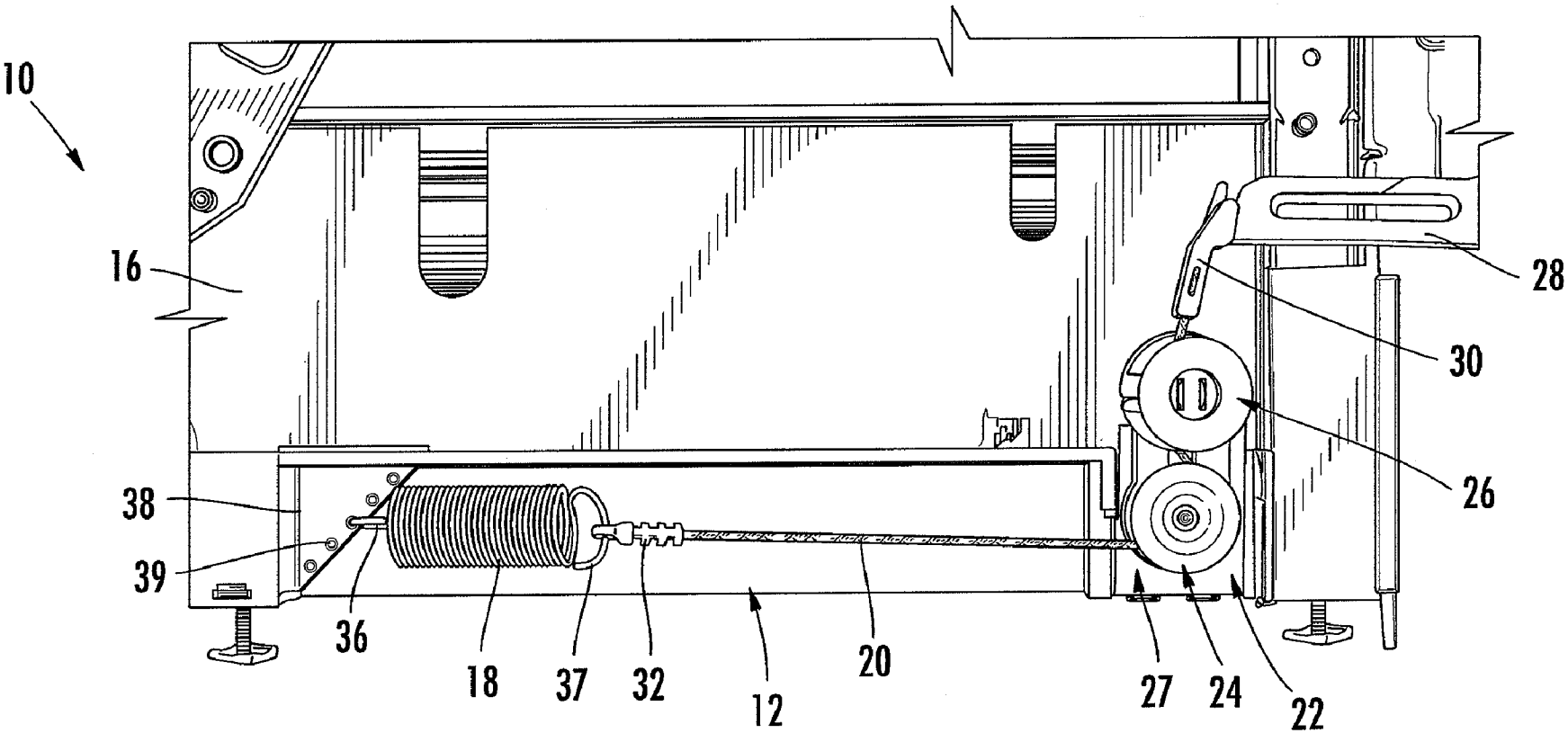
FIG. 2 illustrates the counterbalance assembly of FIG. 1 with the dishwasher door in a closed position.

FIGS. 1 and 2 illustrate a dishwasher 10 including a counterbalance assembly 12 according to one embodiment of the present invention. As explained in further detail below, the counterbalance assembly 12 facilitates pivoting of a door 14 with respect to a body 16 of the dishwasher 10. In general, the counterbalance assembly 12 includes a first biasing member 18, a first flexible element 20, and a guide member 22 which cooperate to allow the door 14 to be smoothly pivoted between open and closed positions, as well as to be maintained in various positions between the open and closed positions.

Although reference is made herein to a dishwasher 10, it is understood that the counterbalance assembly 12 is adapted to be used with other devices where pivoting between a door and a body is necessary. For example, the counterbalance assembly 12 may be used with other kitchen appliances, such as a stove. In addition, although only one counterbalance assembly 12 is shown in FIGS. 1 and 2, it is understood that there may be a counterbalance assembly on both sides of the dishwasher 10.

As shown in FIGS. 1 and 2, the counterbalance assembly 12 includes a first biasing member 18, such as a tension spring or other elastic member made of a memory or resilient material. One end of the first biasing member 18 is attached to a first bracket 38. In one embodiment, the first biasing member 18 includes a hook 36 at its free end that is sized and configured to be positioned within one of a plurality or series of holes 39 defined by the first bracket 38. The first bracket 38 is attached to the body 16 and, by positioning the hook 36 in different holes 39, the tension on the first biasing member 18 may be adjusted (i.e., the series of holes 39 may be obliquely-disposed with respect to the guide member 22 such that moving the hook 36 between holes 39 changes the distance between the first bracket 38 and the guide member 22, and thus the tension exerted by the first biasing member 18 on the first flexible element 20).

Figure 3:
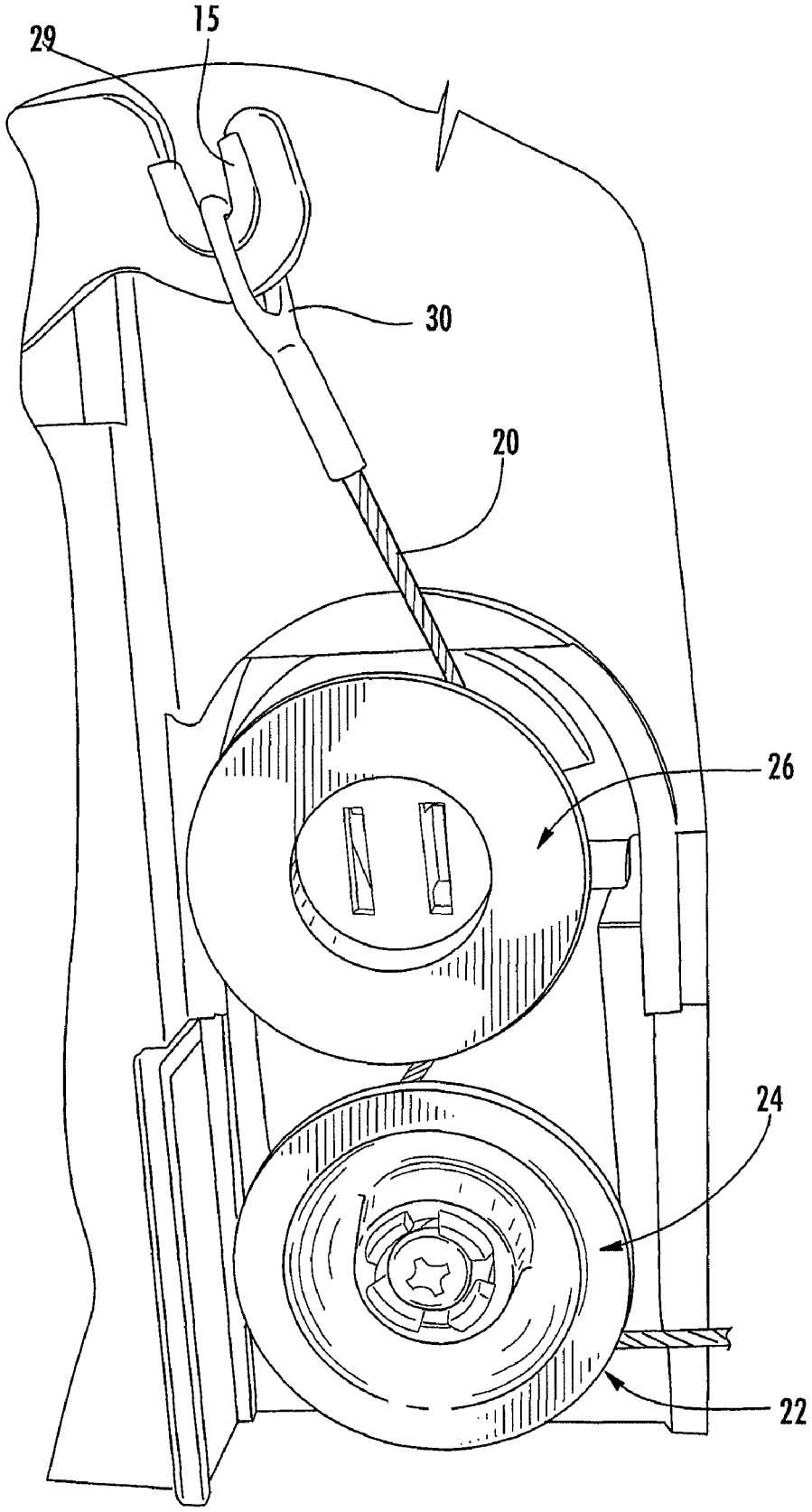
FIG. 3 is an enlarged view of the guide member shown in FIG. 1.

The opposite end of the first biasing member 18 is coupled to a first flexible element 20. In this regard, the first biasing member 18 may include a hook 37 at its free end that is coupled to a first coupling member 32 secured to one end of the first flexible element 20. Thus, the first coupling member 32 may define a hole sized and configured to receive the hook 37 of the first biasing member 18. The opposite end of the first flexible element 20 is coupled to a hinge bracket 28 with a second coupling member 30. In one embodiment, the second coupling member 30 is configured to be positioned within a slot 29 defined by the hinge bracket 28. The first flexible element 20 may be, for example, an inelastic cord, such as a braided material. However, the first flexible element 20 may be comprised of other materials, including elastic materials, capable of maintaining tension between the first biasing member 18 and the hinge bracket 28 to facilitate opening and closing of the door 14. FIG. 3 illustrates that the slot 29 may include a bushing 15 and that the second coupling member 30 may engage the slot and bushing. The bushing 15 may be a non-metallic material (e.g., polymeric) and may reduce squealing between the second coupling member 30 and the slot 29 when the door 14 is opened and closed. The bushing 15 may correspond to the shape of the slot 29, such as be U-shaped as shown in FIG. 3.

The hinge bracket 28 and door 14 may pivot about a hinge pin 34. FIG. 1 illustrates the door 14 in an open position. Thus, in the open position, the portion of the hinge bracket 28 coupled to the first flexible element 20 is generally vertically disposed, while the door 14 is generally horizontally disposed (further, the connection between the first flexible element 20 and the hinge bracket 28 maybe radially displaced and spaced apart from the hinge pin 34). The first biasing member 18 is extended and, thus, further tensioned from a substantially relaxed position. FIG. 2 depicts the door 14 in a closed position. In the closed position, the hinge bracket 28 is generally horizontally disposed (i.e., closer to the first biasing member 18), while the door 14 is generally vertically disposed. Moreover, the first biasing member 18 contracts to a substantially relaxed position, while the overall length of the first flexible element 20 and first biasing member 18, between the hinge bracket 28 and the first bracket 38, is shortened when compared to the open position.

Figure 4:
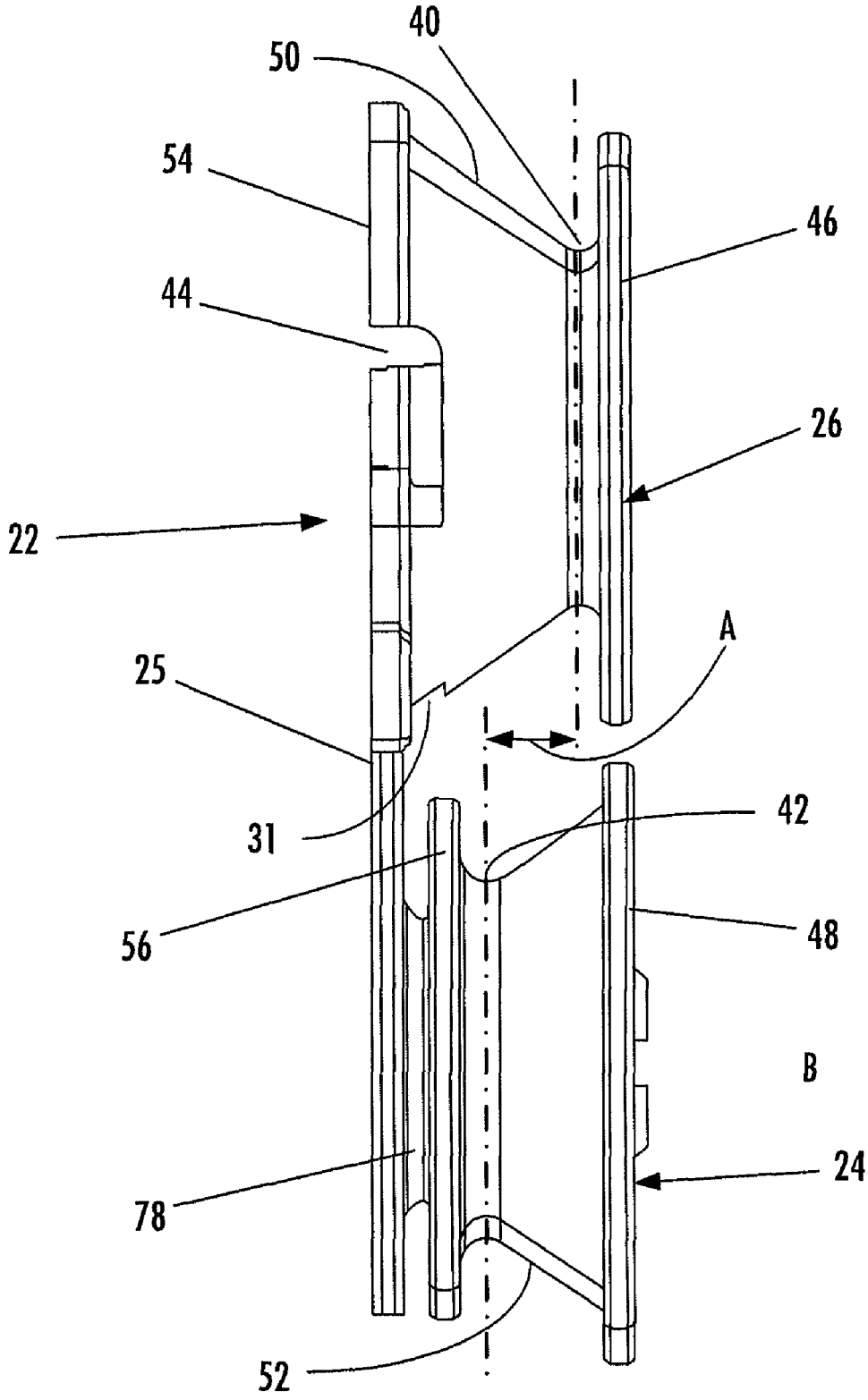
FIG. 4 depicts a side view of a guide member according to an embodiment of the present invention.
Figure 5:
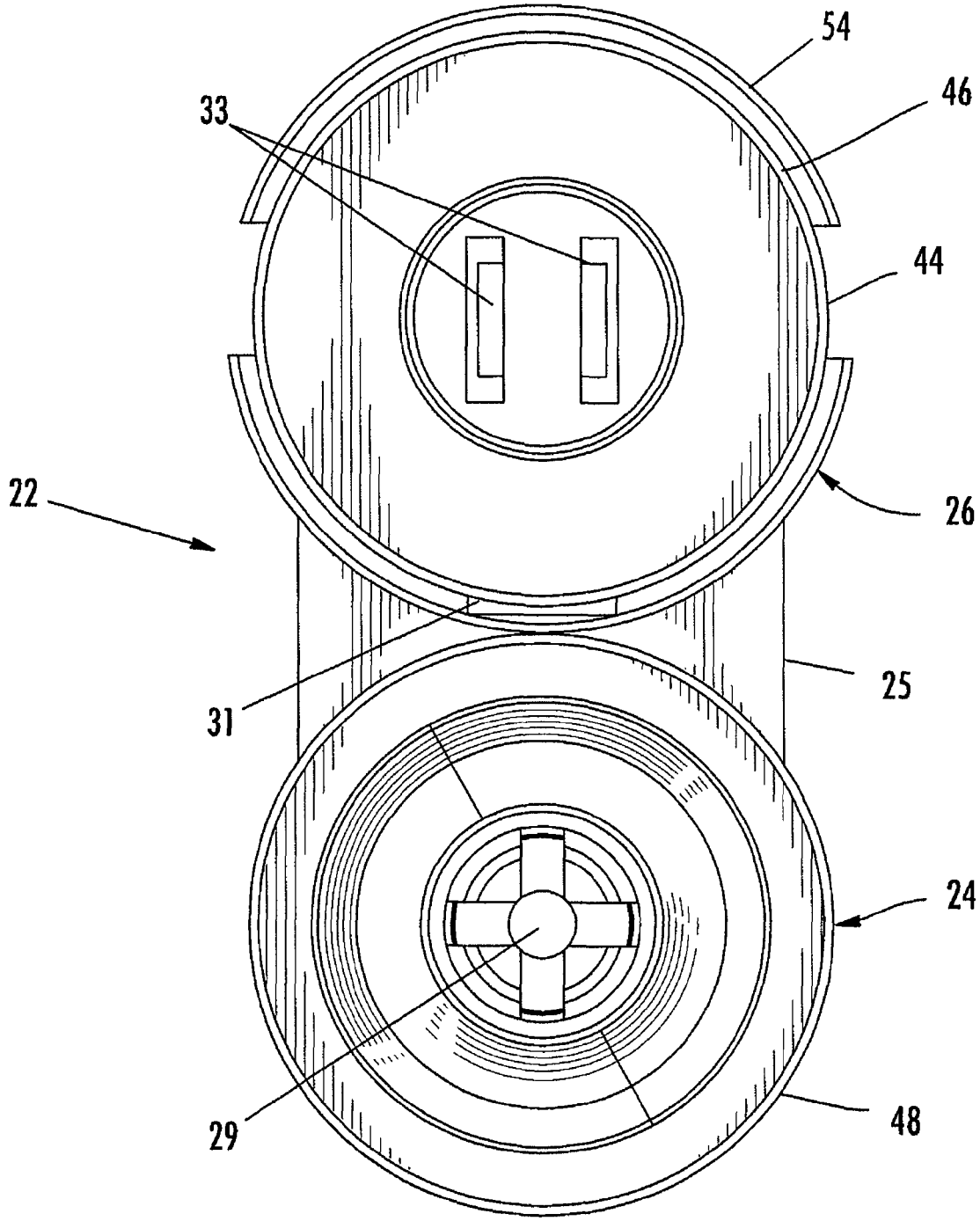
FIG. 5 shows a front view of the guide member shown in FIG. 4.
Figure 6:
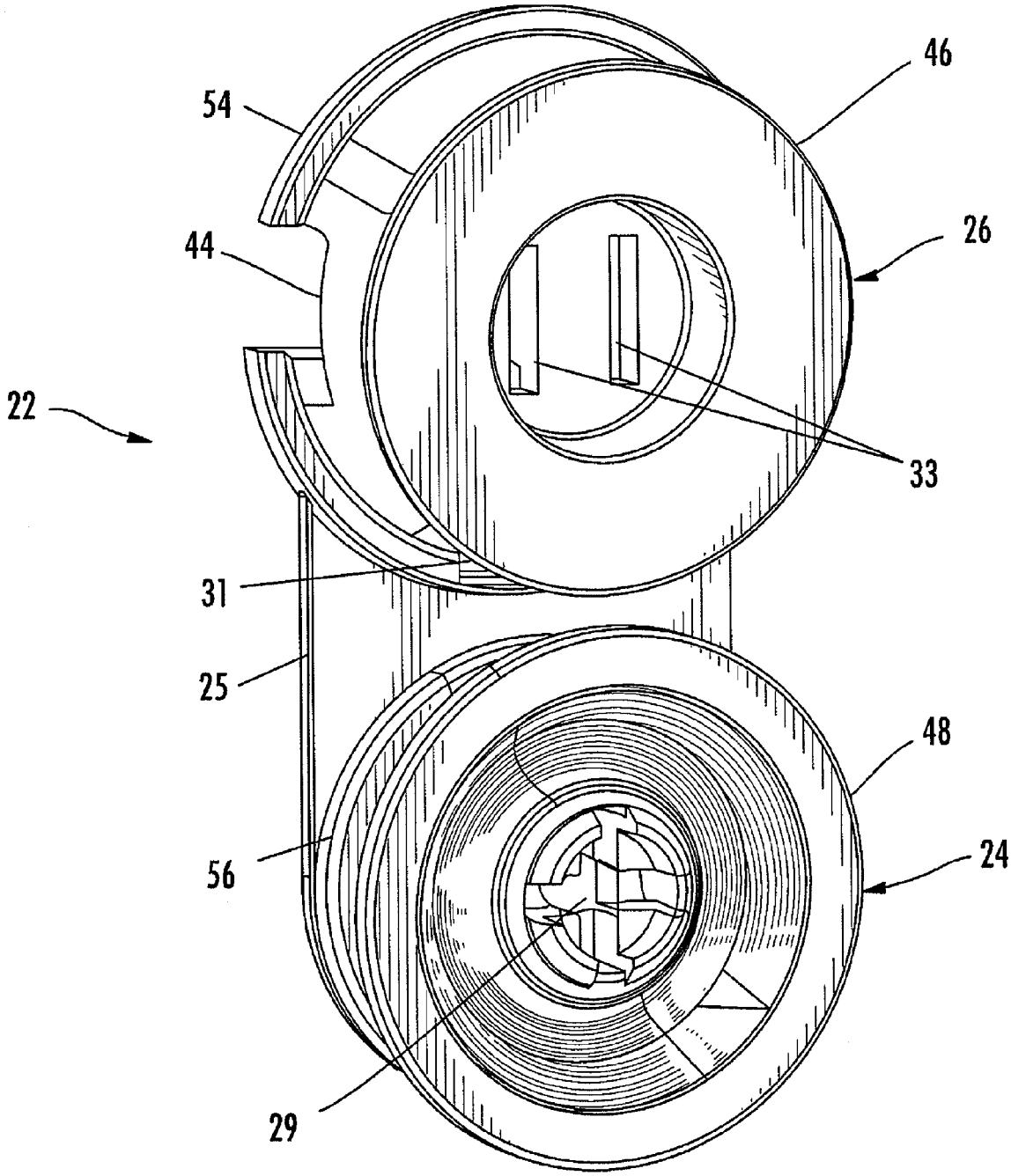
FIG. 6 is a perspective view of the guide member shown in FIG. 4.
Figure 9:
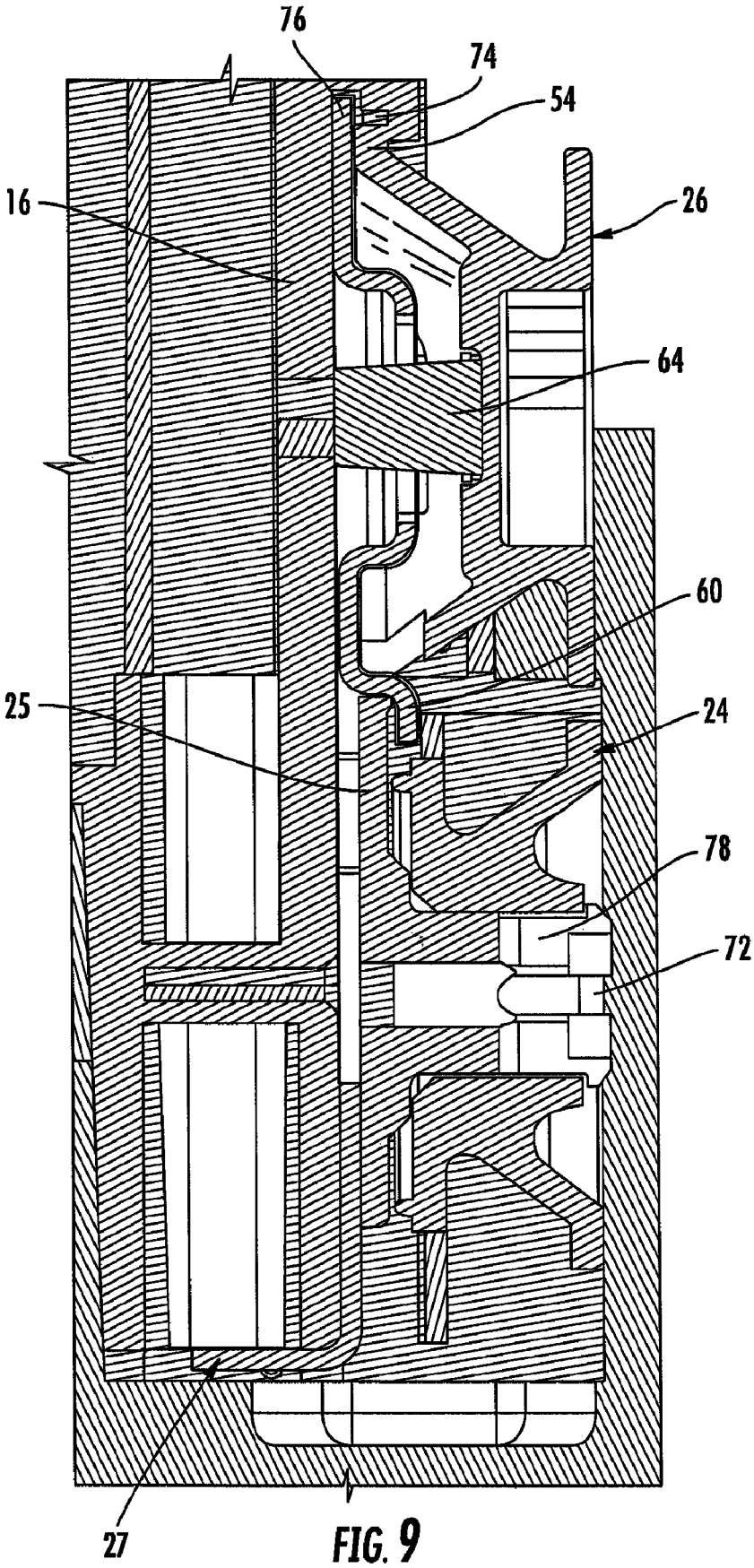
FIG. 9 is a cross-sectional view of a guide member secured to a body of a dishwasher according to an embodiment of the present invention.
Figure 10:
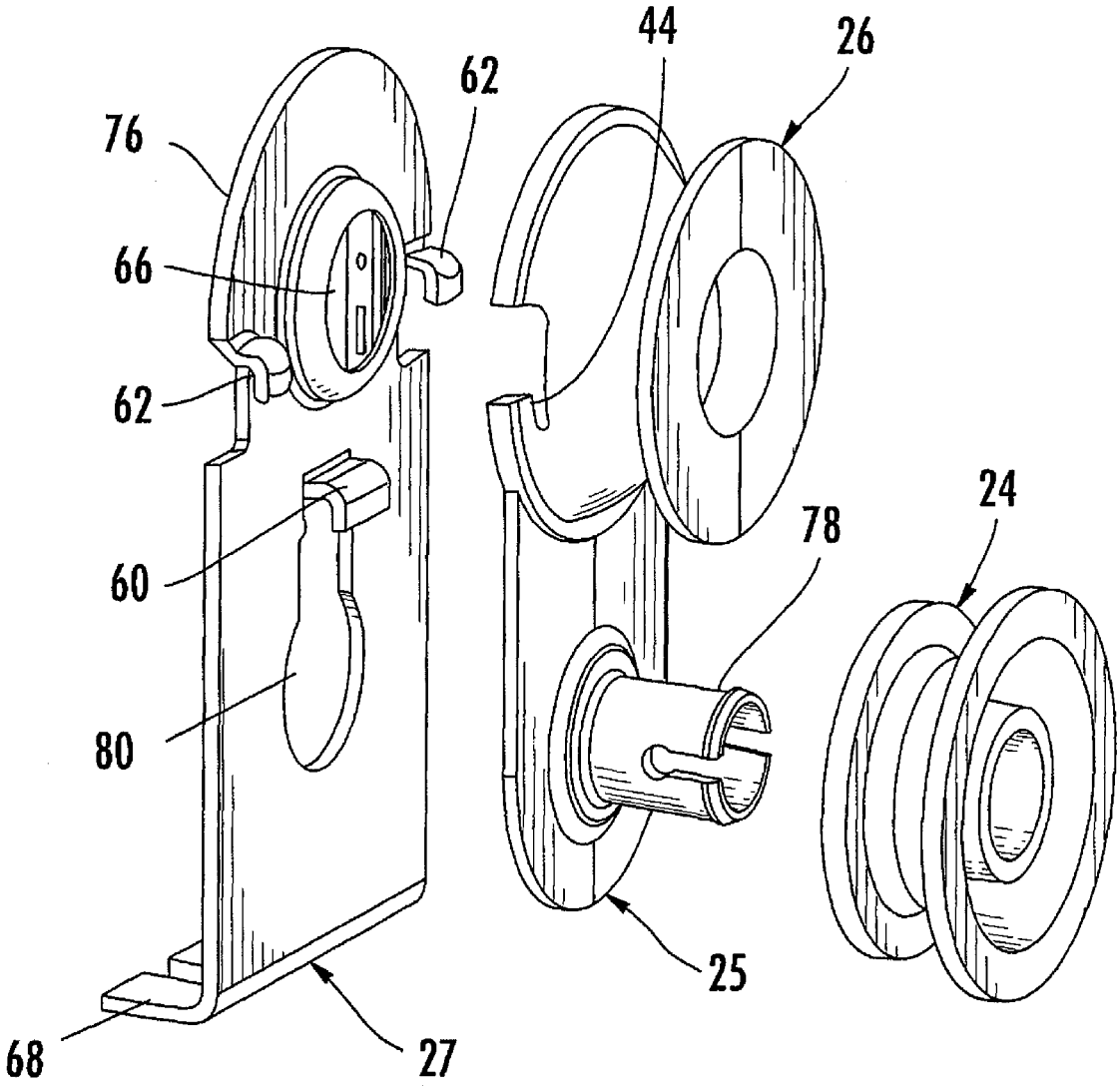
FIG. 10 is an exploded view of a guide member and a bracket according to one embodiment of the present invention.

FIGS. 1 and 2 also illustrate that the counterbalance assembly 12 includes a guide member 22 located proximate to the front of the dishwasher 10 and coupled to the body 16 thereof. The guide member 22 includes a rotatable pulley or pulley element 24 and an arcuate member 26. The rotatable pulley 24 and the arcuate member 26 may be coupled together with a backing 25, as shown in FIGS. 4-6. FIGS. 9 and 10 show that the backing 25 may extend from the arcuate member 25 and include a coupling member 78 that extends outwardly from the backing to engage the pulley 24. The pulley 24 is rotatable about the coupling member 78. As shown in FIG. 5, the outer portions 46, 48 of the arcuate member 26 and pulley 24 may be generally circular in configuration. The arcuate member 26 may also include a frustroconical portion 50 extending between an inner portion 54 and the outer portion 46, while the pulley 24 generally includes a frustroconical portion 52 extending between an inner portion 56 and the outer portion 48, as shown, for example, in FIG. 4.

Figure 7:
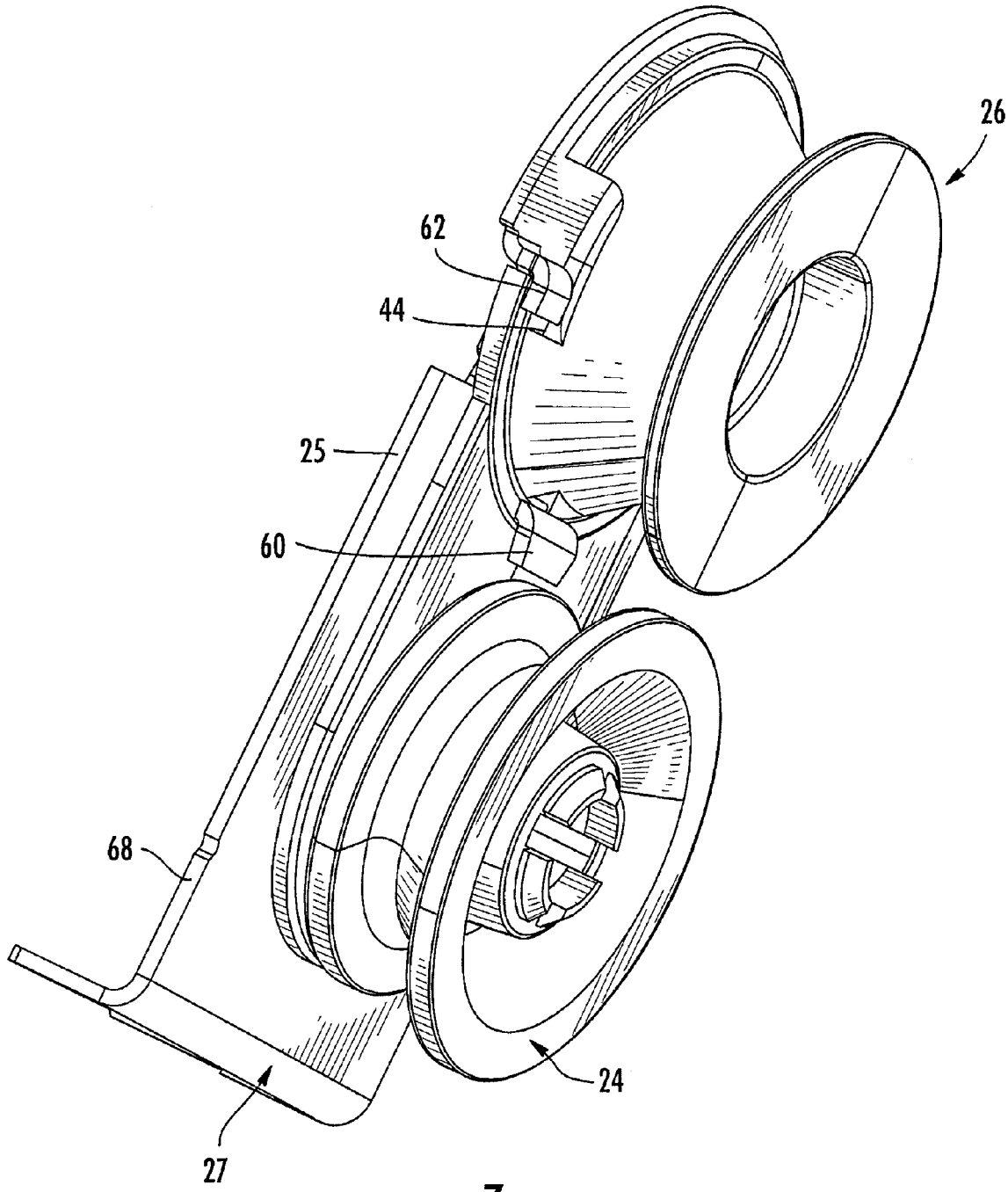
FIG. 7 is a perspective view of a guide member secured to a bracket according to one embodiment of the present invention.
Figure 8:
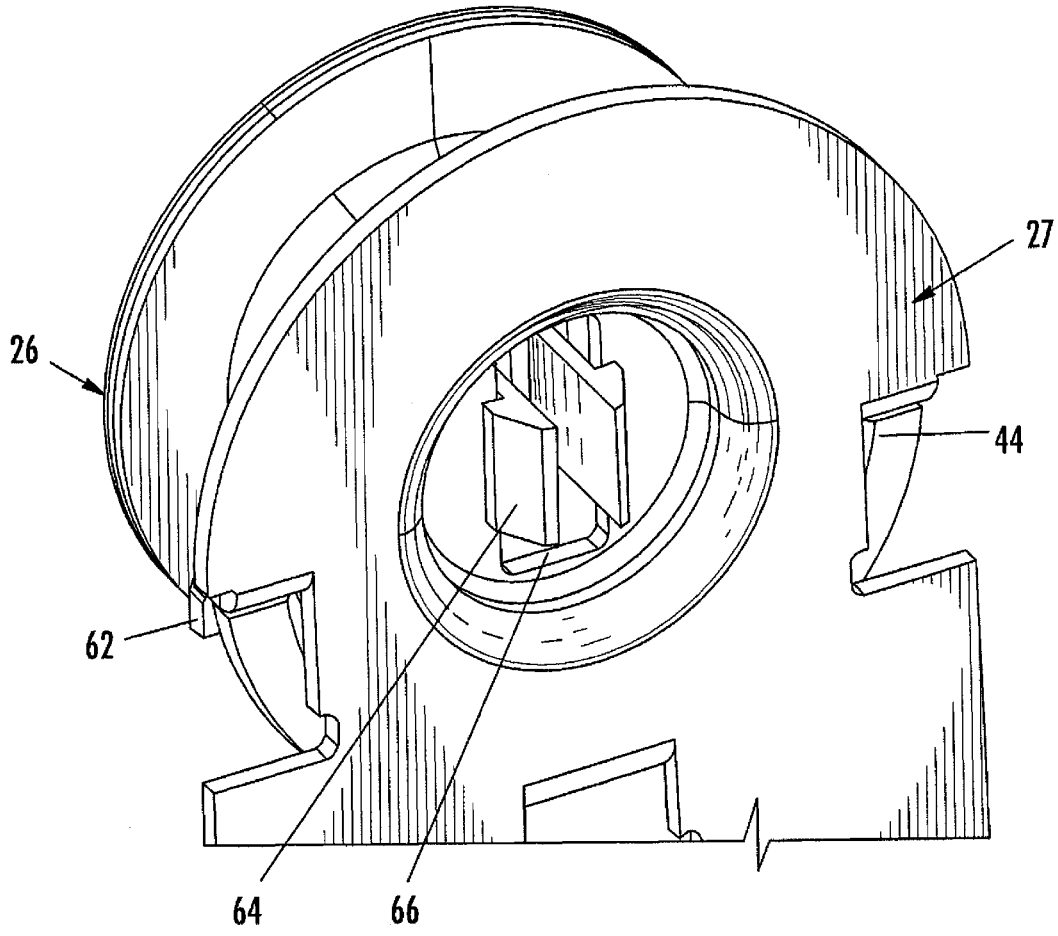
FIG. 8 is a partial perspective view of the guide member secured to the bracket shown in FIG. 7.

In one embodiment, the guide member 22 may be secured to the bracket 27, while the bracket 27 may be secured to the body 16 of the dishwasher, as shown in FIGS. 1, 2 and 7-9. In particular, a slot 31 is defined by a portion of the frustroconical portion 50 and inner portion 54 of the arcuate member 26, while slots 33 are defined by the frustroconical portion 50 so as to extend therethrough. A slot 44 is defined by the inner portion 54 and the frustroconical portion 50 of the arcuate member 26. As shown in FIG. 7, the slot 31 may engage with a clip 60 extending from the bracket 27. In addition, the bracket 27 may also include a pair of clips 62 that engage respective slots 44 of the arcuate member 26. As shown in FIG. 8, the arcuate member 26 may include a biasing clip 64 that biases outwardly to engage a hole 66 defined by the bracket 27. The biasing clip 64 could be disengaged from the bracket 27, for example, by accessing the clip 64 via slots 33 and biasing the ends of the clip 64 together. Furthermore, FIG. 7 demonstrates that the bracket 27 may include an L-shaped member 68 that is configured to extend both adjacent to the backing 25 and perpendicularly under the body 16 of the dishwasher 10. The bracket 27 may be configured to be secured to the body 16 using various techniques. For instance, at least a portion of the inner portion 54 of the arcuate member 26 and an arc-shaped member 76 of the bracket 27 could be configured to engage a slot 74 defined by the body 16, as shown in FIG. 9. The pulley 24 may also include a hole 72 sized and configured to receive a fastener therethrough, which secures the pulley 24 to the body 16, and also provides an axis of rotation (illustrated as axis B in FIG. 4) for the pulley 24. FIG. 10 demonstrates that a fastener may be configured to extend though each of the hole 72 in the pulley 24, the coupling member 78, a hole 80 defined by the bracket 27, and into the body 16.

In one embodiment, the arcuate member 26 of the guide member 22 is fixed, while the pulley 24 of the guide member 22 is rotatable. In addition, the arcuate member 26 and pulley 24 define respective guide tracks 40, 42, as shown in FIG. 4. The guide tracks 40, 42 are generally semi-circular in configuration and are sized and configured to receive the first flexible element 20. The first flexible element 20 is configured to extend in a serpentine manner about one side or portion of the arcuate member 26 and one side or portion of the lower pulley 24, within the guide tracks 40, 42. The arcuate member 26 provides friction with the first flexible element 20 such that the door 14 can be maintained in any position between the fully opened and the fully closed positions. The rotatable lower pulley 24 guides the first flexible element 20 and may be less prone to squealing (due to the rotating interaction with the flexible element) than, for example, instances in which the pulley or other lower member is fixed.

FIG. 4 illustrates an additional aspect of the guide member 22. In this regard, the guide track 40 of the fixed arcuate member 26 is parallel to and laterally offset from the guide track 42 of the pulley 24, with respect to the axis B about which the pulley 24 rotates. The offset distance is designated as reference A in FIG. 4. As such, the first flexible element 20 engages the guide track 40 of the fixed arcuate member 26 at a different lateral position (i.e., spaced further outward from the body 16 of the dishwasher 10) than the guide track 42 of the pulley 24. Thus, from the side view shown in FIG. 4, the first flexible element 20 would extend obliquely between the pulley 24 and arcuate member 26. The offset between the pulley 24 and arcuate member 26 may allow the first biasing member 18 to be disposed further inward under the body 16 of the dishwasher 10, while the hinge bracket 28 may be spaced laterally outward therefrom to clear the sides of the body 16.

It is understood that the exemplary guide member 22 shown in FIGS. 1-10 is not meant to be limiting and may be various sizes and configurations in additional aspects of the present invention. For example, the arcuate member 26 and pulley 24 may be independently secured to the body 16 such that the backing 25 is unnecessary. Similarly, different techniques may be employed to secure the pulley 24 and arcuate member 26 to the body 16, such as with fasteners, clips, rivets, adhesives, and the like. Moreover, the arcuate member 26 may be other configurations than circular, such as semi-circular, and still provide a semi-circular guide track 40 for the first flexible element 20 to interact therewith. The pulley 24 and arcuate member 26 may be different sizes to accommodate different dishwashers 10 and first flexible elements 20. For instance, the guide tracks 40, 42 may be other sizes and configurations depending on the size and configuration of the flexible element. Furthermore, the offset distance A may be varied in order to achieve a desired tension in the first flexible element 20 between the pulley 24 and the arcuate member 26 for opening and closing the door 14 (e.g., increasing the offset distance A for a heavier door 14). In still other instances, the positions of the pulley 24 and the arcuate member 26 may be reversed, or the guide member 22 may be disposed and engaged with the dishwasher 10 such that the pulley 24 and arcuate member 26 are non-vertically oriented. Additionally, it may be desirable for certain applications to fix the pulley 24 and allow the arcuate member 26 to rotate, fix both the pulley 24 and arcuate member 26, or allow both the pulley 24 and arcuate member 26 to rotate.

In some instances, the counterbalance assembly 12 may further include a second biasing member 100, in addition to the first biasing member 18, to provide a dual-biasing or multi-biasing configuration, as shown in FIGS. 11-14. By supplementing the first biasing member 18 with the second biasing member 100, the counterbalance assembly 12 may be capable of supporting a relatively heavier door 14 as the door is pivoted between the fully open and fully closed positions. Although only one counterbalance assembly 12 is shown in FIGS. 11-14, it is understood that there may be a counterbalance assembly 12 on both sides of the dishwasher 10.

As illustrated in FIGS. 11-14, the counterbalance assembly 12 may include the second biasing member 100, such as a tension spring or other elastic member made of a memory or resilient material. One end of the second biasing member 100 may be attached, coupled, or otherwise secured to a second bracket 102 (in some instances, however, the second bracket 102 may be integral with the first bracket 38). In one embodiment, the second biasing member 100 may include a hook 104 at its free end, which is sized and configured to be positioned within one of a plurality or series of holes 106 defined by the second bracket 102. The second bracket 102 may be attached, coupled, or otherwise secured to the body 16 and, by positioning the hook 104 in different holes 106, the tension on the second biasing member 100 may be adjusted (i.e., the series of holes 106 may be obliquely-disposed with respect to the guide member 22 such that moving the hook 104 between holes 106 changes the distance between the second bracket 102 and the guide member 22, and thus the tension exerted by the second biasing member 100 on a second flexible element 120).

Further, the opposite end of the second biasing member 100 may be coupled to a second flexible element 120. In this regard, the second biasing member 100 may include a hook 108 at its free end that is coupled to a third coupling member 110 secured to one end of the second flexible element 120. Thus, the third coupling member 110 may define a hole sized and configured to receive the hook 104 of the second biasing member 100. The opposite end of the second flexible element 120 may be coupled to the hinge bracket 28 (at the same position as or separate from the second coupling member 30 associated with the first flexible element 20) with a fourth coupling member 130. In one embodiment, the fourth coupling member 130 may be configured to be positioned within the slot 29 defined by the hinge bracket 28 such that both the second coupling member 30 and the fourth coupling member 130 are coupled or otherwise secured thereto. In other instances, however, the second coupling member 30 and the fourth coupling member 130 may be coupled to the door 14/hinge bracket 28 at different positions. The second flexible element 120 may be, for example, an inelastic cord, such as a braided material. However, the second flexible element 120 may be comprised of other materials, including elastic materials, capable of maintaining tension between the second biasing member 100 and the hinge bracket 28 to facilitate opening and closing of the door 14. As shown in FIG. 3, the slot 29 may include the bushing 15 such that the second coupling member 30 and the fourth coupling member 130 (not shown in FIG. 3) may engage the slot 29 and bushing 15, so as to reduce squealing between the coupling members 30, 130 and the slot 29 when the door 14 is opened and closed.

As described previously, the first flexible element 20 may be configured to extend in a serpentine manner about the arcuate member 26 about a first side 140 thereof (i.e., disposed toward the first biasing member 18) and the lower pulley 24, about a second side thereof (wherein the second side of the lower pulley 24 is disposed opposite the lower pulley 24 from the first and second biasing members 18, 100), within the guide tracks 40, 42. Accordingly, the first side 140 of the arcuate member 26 may provide friction with the first flexible element 20 such that the door 14 can be maintained in various positions between the fully opened and the fully closed positions and/or prevented from inadvertently pivoting to the open or closed positions. To further facilitate maintaining the door 14 at various positions (particularly with a relatively heavier door 14), the second flexible element 120 may be configured to extend or otherwise wrap about the fixed arcuate member 26. For example, the second flexible element 120 may extend from the second biasing member 100 in a substantially horizontal or, in other instances, angled direction toward the fixed arcuate member 26 such that the second flexible element 120 engages the guide track 40 thereof. Further, in some instances, the second flexible element 120 may wrap about the fixed arcuate member 26 about a second side 145 thereof (substantially opposite to the first side 140) and extend substantially vertically therefrom to be coupled to the door 14 at the hinge bracket 28. As such, both the first flexible member 20 and the second flexible member 120 may be engaged with the fixed arcuate member 26 so as to be opposed to each other about the guide track 40. Furthermore, the first flexible member 20 and the second flexible member 120 may be wrapped about first and second sides 140, 145, respectively, such that the first and second flexible members 20, 120 extend from opposite sides of the fixed arcuate member 26 toward the hinge bracket 28. In this manner, the second biasing member 100 may provide additional/supplemental support to the door 14 as its position varies between the fully open and closed positions.

In one aspect of the counterbalance assembly 12 having the first and second biasing members 18, 100, the guide track 40 of the fixed arcuate member 26 may be parallel to and offset from the guide track 42 of the pulley element 24, with respect to the axis about which the pulley element 24 rotates. As such, the first and second flexible members 20, 120 may engage the guide track 40 of the fixed arcuate member 26 at a different lateral position (i.e., spaced further outward from the base of the dishwasher) than the lateral position at which the first flexible member 20 engages the guide track 42 of the pulley element 24. In this manner, for example, the first flexible member 20/first biasing member 18 may be disposed further inward under a base portion 200 of the dishwasher 10, while the hinge bracket 28 can be spaced laterally outward therefrom to clear the sides of the body 16 of the dishwasher 10.

Figure 11:
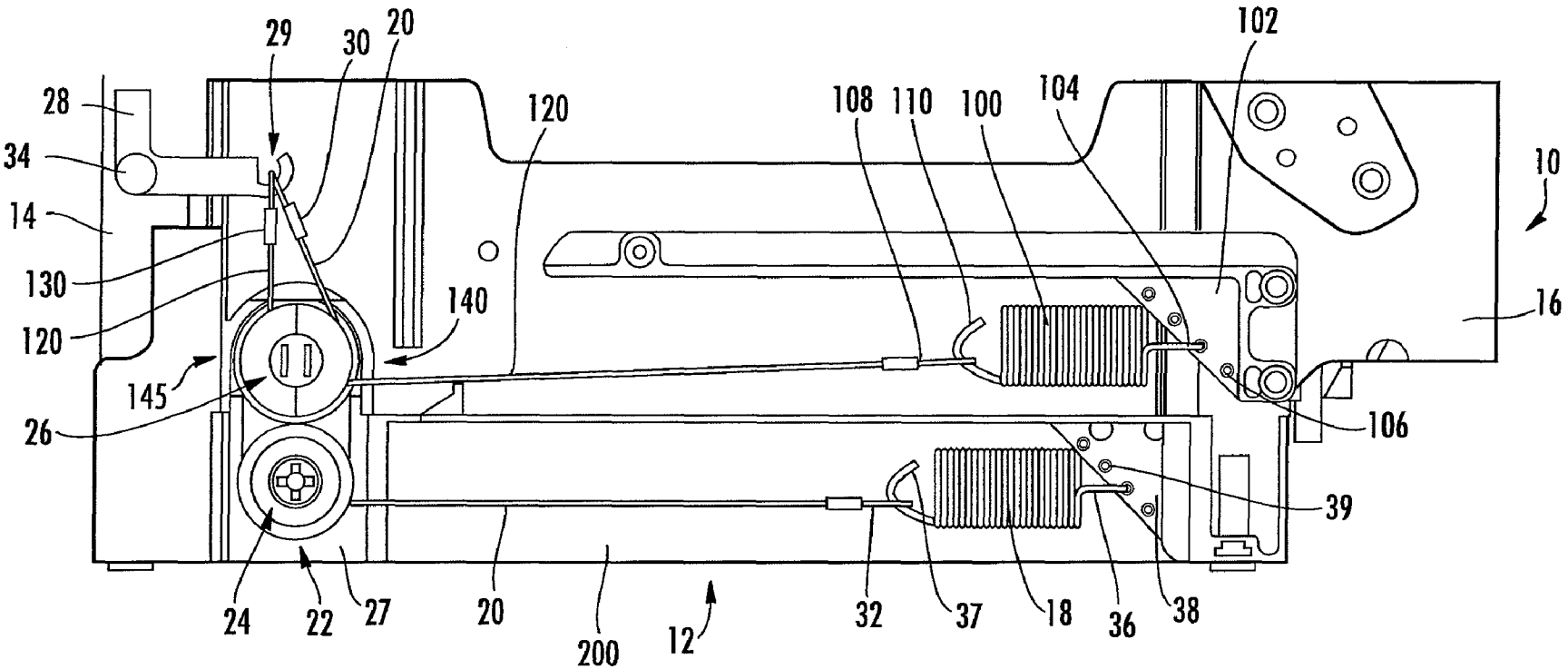
FIG. 11 illustrates a partial side view of a dishwasher including a door counterbalance assembly having a pair of biasing members, with a dishwasher door in a closed position, according to one embodiment of the present invention.
Figure 12:
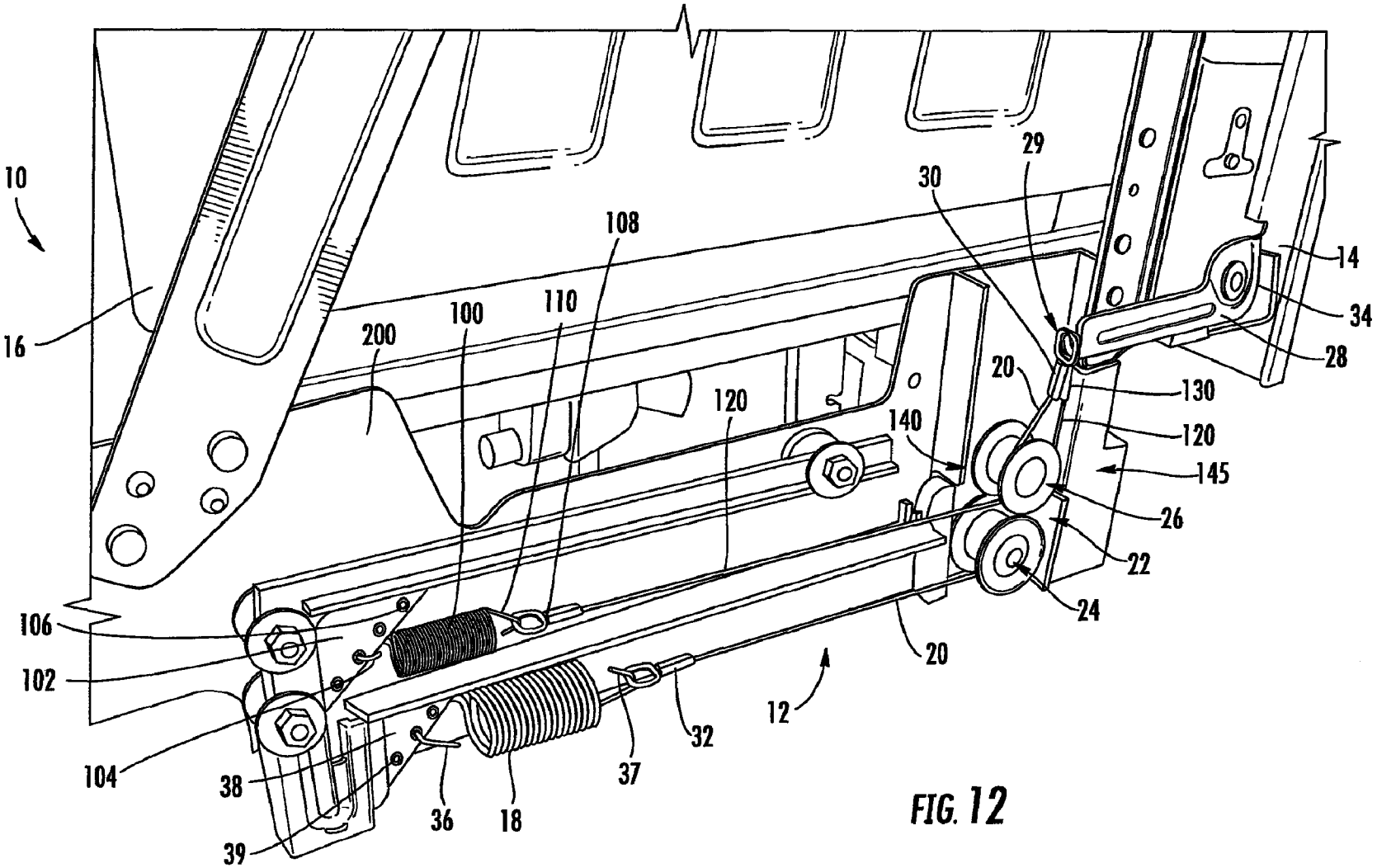
FIG. 12 illustrates a partial perspective view of a dishwasher including a door counterbalance assembly having a pair of biasing members, with a dishwasher door in a closed position, according to one embodiment of the present invention.

In some embodiments, the hinge bracket 28 and door 14 may pivot about the hinge pin 34. FIG. 14 illustrates the door 14 in a fully open position, wherein the door 14 is substantially parallel with a ground surface. Thus, in the open position, the portion of the hinge bracket 28 to which the first and second flexible elements 20, 120 are coupled may be generally vertically disposed (i.e., the connection between the first and second flexible elements 20, 120 and the hinge bracket 28 maybe radially displaced and spaced apart from the hinge pin 34), while the door 14 is generally horizontally disposed. In this regard, the first and second biasing members 18, 100 may be extended and, thus, further tensioned from a substantially relaxed position. FIGS. 11 and 12 depict the door 14 in a fully closed position, wherein the door 14 is substantially perpendicular with the ground surface. In the closed position, the portion of the hinge bracket 28 to which the first and second flexible elements 20, 120 are coupled may be generally horizontally disposed (i.e., closer to the first and second biasing members 18, 100), while the door 14 is generally vertically disposed. In this regard, the first and second biasing members 18, 100 may contract to a substantially relaxed position, while the overall length of the first and second flexible elements 20, 120 and first and second biasing members 18, 100, between the hinge bracket 28 and the first and second brackets 38, 102, is shortened when compared to the open position. FIG. 13 illustrates the door 14 in a medial position between the fully open and closed positions, wherein the door 14 is angled with respect to the ground surface and the body 16 of the dishwasher 10. In the medial position, the first and second biasing members 18, 100 may be extended and, thus, tensioned from a substantially relaxed position, but not to the extent at which the first and second biasing member 18, 100 are extended when the door is in the fully open position.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An appliance, comprising:

an appliance body;

a door pivotably engaged with the appliance body; and a counterbalance assembly coupled to the appliance body for facilitating pivoting of the door about the engagement with the appliance body, the counterbalance assembly comprising:

a first and a second biasing member, each biasing member being coupled to the appliance body;

a guide member coupled to the appliance body and including a fixed arcuate member defining a first guide track, and a pulley element rotatable about an axis and defining a second guide track, the first guide track of the fixed arcuate member being parallel to and offset from the second guide track of the pulley element along the axis thereof;

a first flexible element having a first end serially engaged with the first biasing member and extending therefrom to at least partially wrap about the pulley element and about a first side of the fixed arcuate member, so as to serially engage the first and second guide tracks, whereafter a second end of the first flexible member, opposed to the first end thereof, is coupled to the door; and a second flexible element having a first end serially engaged with the second biasing member and extending therefrom to at least partially wrap about a second side of the fixed arcuate member so as to engage the first guide track, the second side of the fixed arcuate member being substantially opposite the first side thereof, whereafter a second end of the second flexible member, opposed to the first end thereof, is coupled to the door.

2. An appliance according to claim 1 wherein the appliance body is a dishwasher appliance body.

3. An appliance according to claim 1 wherein the first guide track of the fixed arcuate member is disposed further laterally outward from the appliance body than the second guide track of the pulley element.

4. An appliance according to claim 1 wherein the pulley element includes a first side disposed toward the first biasing member, and an opposing second side, wherein the first side of the fixed arcuate member is disposed toward the first biasing member, and wherein the first flexible element is configured to extend from the first biasing member and at least partially about the second side of the pulley member in the second guide track thereof, before extending obliquely from the second guide track of the pulley element to the first guide track of the fixed arcuate member at least partially about the first side thereof, before the second end thereof is coupled to the door.

5. An appliance according to claim 1 further comprising a bracket configured to support the guide member and to couple the guide member to the appliance body.

6. An appliance according to claim 1 further comprising a hinge bracket operably engaged between the door and the appliance body and including a flange extending radially from the pivotable engagement therebetween, the flange being configured to receive the second ends of each of the first and second flexible members so as to couple the first and second flexible members to the door.

7. An appliance according to claim 1 further comprising at least one adjustment bracket operably engaged with the appliance body, the at least one adjustment bracket defining a series of holes obliquely-disposed with respect to the guide member, wherein each of the first and second biasing members is configured to engage one of the obliquely-disposed holes of the at least one adjustment bracket so as to adjust a tension on the respective one of the first and second flexible members.

8. A method for facilitating pivoting of a door with respect to a body of an appliance, the body including a guide member secured thereto, the guide member including a fixed arcuate member defining a first guide track and a pulley element rotatable about an axis and defining a second guide track, the first guide track of the fixed arcuate member being parallel to and offset from the second guide track of the pulley element along the axis thereof, the method comprising:

coupling each of a first and a second biasing member to a body of an appliance, the body having a door pivotably engaged therewith;

serially engaging a first end of each of a first and a second flexible element with the respective first and second biasing member;

coupling a second end of each of the first and second flexible elements to the door, the second ends being opposed to the respective first ends of the first and second flexible elements;

wrapping the first flexible element at least partially about the pulley element and about a first side of the fixed arcuate member, such that the first flexible element serially engages the first and second guide tracks; and wrapping the second flexible element at least partially about a second side of the fixed arcuate member, such that the second flexible element engages the first guide track, the second side of the fixed arcuate member being opposite the first side.

9. A method according to claim 8 further comprising securing a guide member to the body such that the first guide track of the fixed arcuate member is disposed further laterally outward from the body than the second guide track of the pulley element.

10. A method according to claim 8 wherein the pulley element includes a first side disposed toward the first biasing member, and an opposing second side, wherein the first side of the fixed arcuate member is disposed toward the first biasing member, and wherein rapping the first flexible element further comprises wrapping the first flexible element at least partially about the second side of the pulley member in the second guide track thereof, and at least partially about the first side of the fixed arcuate member in the first guide track thereof, such that the first flexible element extends obliquely from the second guide track of the pulley element to the first guide track of the fixed arcuate member.

11. A method according to claim 8 wherein a hinge bracket is operably engaged between the door and the body and includes a flange extending radially from the pivotable engagement therebetween, and wherein coupling the second ends of each of the first and second flexible elements to the door further comprises coupling the second ends of each of the first and second flexible elements to the flange such that the second ends of each of the first and second flexible members are radially spaced apart from the pivotable engagement between the door and the body.

12. A method according to claim 8 wherein at least one adjustment bracket is operably engaged with the body and defines a series of holes obliquely-disposed with respect to the guide member, and wherein coupling each of a first and a second biasing member to the body further comprises coupling each of a first and a second biasing member to one of the obliquely-disposed holes of the at least one adjustment bracket so as to adjust a tension on the respective one of the first and second flexible members.

13. A counterbalance assembly coupled between a door and a body of an appliance, for facilitating pivoting of the door with respect to the body, the counterbalance assembly comprising:

a first and a second biasing member, each biasing member being adapted to be coupled to the body;

a guide member adapted to be coupled to the body and including a fixed arcuate member defining a first guide track, and a pulley element rotatable about an axis and defining a second guide track, the first guide track of the fixed arcuate member being parallel to and offset from the second guide track of the pulley element along the axis thereof, a first flexible element having a first end serially engaged with the first biasing member and extending therefrom to at least partially wrap about the pulley element and about a first side of the fixed arcuate member, so as to serially engage the first and second guide tracks, whereafter a second end of the first flexible member, opposed to the first end thereof, is adapted to be coupled to the door; and a second flexible element having a first end serially engaged with the second biasing member and extending therefrom to at least partially wrap about a second side of the fixed arcuate member so as to engage the first guide track, the second side of the fixed arcuate member being substantially opposite the first side, whereafter a second end of the second flexible member, opposed to the first end thereof, is adapted to be coupled to the door.

14. A counterbalance assembly according to claim 13 wherein the first guide track of the fixed arcuate member is adapted to be disposed further laterally outward from the body than the second guide track of the pulley element.

15. A counterbalance assembly according to claim 13 wherein the pulley element includes a first side disposed toward the first biasing member, and an opposing second side, wherein the first side of the fixed arcuate member is disposed toward the first biasing member, and wherein the first flexible element is configured to extend from the first biasing member and at least partially about the second side of the pulley member in the second guide track thereof, before extending obliquely from the second guide track of the pulley element to the first guide track of the fixed arcuate member at least partially about the first side thereof, before extending toward the door.

16. A counterbalance assembly according to claim 13 further comprising a bracket configured to support the guide member and adapted to couple the guide member to the body.

17. A counterbalance assembly according to claim 13 further comprising a hinge bracket adapted to be operably engaged between the door and the body and including a flange adapted to extend radially from the pivotable engagement therebetween, the flange being configured to receive the first and second flexible members so as to couple the first and second flexible members to the door.

18. A counterbalance assembly according to claim 13 further comprising at least one adjustment bracket adapted to be operably engaged with the body, the at least one adjustment bracket defining a series of holes obliquely-disposed with respect to the guide member, wherein each of the first and second biasing members is configured to engage one of the obliquely-disposed holes of the at least one adjustment bracket so as to adjust a tension on the respective one of the first and second flexible members.

* * * * *